United States Patent [19]

Haugen

[11] 4,224,170

[45] Sep. 23, 1980

[54] RUST INHIBITING ADDITIVE COMPOSITIONS FOR OILS

[75] Inventor: Haakon Haugen, Oslo, Norway

[73] Assignee: Texaco Inc., White Plains, N.Y.

[21] Appl. No.: 958,305

[22] Filed: Nov. 6, 1978

[51] Int. Cl.[2] ..... C10M 1/48; C10M 1/40; C10M 1/32; C10M 3/42

[52] U.S. Cl. ..... 252/32.7 E; 252/33; 252/389 A

[58] Field of Search ..... 252/33, 51.5 R, 32.7 E, 252/389 R, 389 A

[56] References Cited

U.S. PATENT DOCUMENTS

| | | | |
|---|---|---|---|
| 2,739,126 | 3/1956 | Benbury et al. | 252/33.4 |
| 3,627,681 | 12/1971 | Chandler | 252/32.7 E |
| 4,010,107 | 3/1977 | Rothert | 252/32.7 E |
| 4,129,508 | 12/1978 | Frühauf | 252/33 |

*Primary Examiner*—Herbert Levine
*Assistant Examiner*—Irving Vaughn
*Attorney, Agent, or Firm*—Carl G. Ries; Robert A. Kulason; James J. O'Loughlin

[57] ABSTRACT

Compositions which include mixtures of a calcium hydroxide overbased oil-soluble calcium sulfonate, hexylene glycol and a surfactant consisting of an ethoxylated aliphatic amine, particularly, diethoxylated cocoamine or diethoxylated soyamine, are useful as rust inhibiting additives for oils and the like. By incorporating these compositions in petroleum based oils such as petroleum based oils of lubricating oil quality which come into contact with metal surfaces under conditions such that the metal surfaces tend to rust or otherwise be subject to deterioration it is possible to inhibit rust formation on such metal surfaces.

12 Claims, No Drawings

RUST INHIBITING ADDITIVE COMPOSITIONS FOR OILS

BACKGROUND OF THE INVENTION

1. Field of the Invention

Rusting of critical engine parts causes premature engine trouble and shortens engine life. The role of the lubricating oil as the primary deterrent to engine rusting is widely recognized. The increasing oil drain intervals recommended by car manufacturers increase the importance of having effective rust inhibitors present in automotive lubricating oils. Since oils with high alkalinity prevent corrosion, alkaline agents such as overbased calcium and barium salts of organic sulfonates are useful rust inhibitors. However, these additives contribute to the ash of the oil. In order to provide an effective rust inhibitor in automotive lubricating oils while reducing the ash content of the oil, efforts have been made to find improved rust inhibiting compositions.

2. Description of the Prior Art

Such compositions for preventing the corrosion of metals have been described previously. For example, U.S. Pat. No. 2,739,126 discloses an anti-corrosive composition which contains a polyvalent metal sulfonate and an oil-soluble glycol. U.S. Pat. No. 2,785,078 discloses aliphatic diamines as corrosion inhibiting additives in compositions which include petroleum oils.

Fuel compositions which include calcium overbased calcium sulfonates are disclosed in U.S. Pat. Nos. 3,539,312 and 3,707,360. These compositions are described therein as being useful as smoke suppressants.

U.S. Pat. No. 3,969,235 discloses succinimides prepared from polybutene-$P_2S_5$ and an alkenylsuccinic anhydride as components of lubricating oil compositions.

A mixture of fatty material consisting essentially of dimers and trimers of ethylenic fatty acids and of a phenolic compound is disclosed as an additive for fuel compositions in U.S. Pat. No. 3,346,355.

BRIEF SUMMARY OF THE INVENTION

The present invention provides novel compositions useful as rust inhibiting additives for oils and the like which comprise admixtures of a calcium hydroxide overbased oil-soluble calcium sulfonate, hexylene glycol and a surfactant consisting of an ethoxylated aliphatic amine, particularly, diethoxylated cocoamine or diethoxylated soyamine. By incorporating the compositions of this invention in petroleum based oils, such as petroleum based oils of lubricating oil quality, which are in contact with metal surfaces under conditions such that the metal surfaces tend to rust or otherwise be subject to deterioration, it is possible to inhibit rust formation on such metal surfaces.

DETAILED DESCRIPTION OF THE INVENTION

In accordance with the present invention compositions useful as ashless rust inhibitors have been prepared which comprise an admixture of a calcium hydroxide overbased oil-soluble calcium sulfonate, hexylene glycol and a surfactant selected from the group consisting of ethoxylated aliphatic amines. All three of the components in this rust inhibiting composition are known compounds previously used as fuel additives. However, it has been unexpectedly found that a mixture of these three compounds is extremely effective in inhibiting rust formation on metal surfaces under conditions where the metal surfaces tend to rust or otherwise deteriorate. The extent of the effectiveness of the three component compositions of the present invention is not attributable to a simple addition of the protective properties of the individual components but represents a synergestic effect obtainable only when all three components are present.

The compositions of the present invention are useful as rust inhibiting additives for preservative type oils, in particular, for gasoline engine crankcase lubricating oils such as, for example, those oils which will meet the requirements of military specifications MIL-L-210413 and/or MIL-L-21260A.

The first component of the rust inhibiting composition of the present invention is a calcium hydroxide overbased oil-soluble calcium sulfonate, particularly one which contains approximately 30–35% by weight active ingredients. Such overbased calcium sulfonates are described in co-assigned U.S. Pat. Nos. 3,539,312 and 3,707,360. The disclosures thereof are hereby incorporated into the present disclosure.

A slightly overbased dispersant is prepared by reacting calcium hydroxide, calcium chloride, and an oil-soluble sodium sulfonate in the presence of a low viscosity solvent refined lubricating oil, e.g. 100 E Pale Oil HF, and methanol. This reaction is carried out at a temperature of about 28°–53° C. for 3 hours followed by heating to about 180° C., stripping out the excess methanol, then filtering to remove excess lime. The calcium hydroxide overbased oil-soluble calcium sulfonate which is so prepared contains about 2% by weight calcium, e.g. 1.93% by weight calcium.

The second component of the rust inhibiting composition in accordance with the present invention is hexylene glycol (4-methyl-2,4-pentanediol).

The third and final component of the rust composition is a surfactant selected from the group consisting of ethoxylated saturated or unsaturated aliphatic amines having the formula $R—N[(CH_2CH_2O)_xH]_2$ wherein R is an aliphatic group, preferably an alkyl group in the range $C_8$–$C_{18}$, and x is 2–15, preferably 2. Examples of ethoxylated aliphatic amines which are usefully incorporated in the compositions of the present invention are diethoxylated soyamine and diethoxylated cocoamine. Particularly useful is diethoxylated cocoamine having the approximate formula

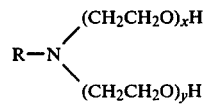

wherein the R moiety is derived from cocoamine and is substantially a $C_{12}$ alkyl group and wherein x and y may be any integer from 0 to 2 inclusive and $x+y=2$. Ethoxylated aliphatic amines such as ethoxylated cocoamines are commercially available from Armour Industrial Chemical Company, Chicago, Ill., under the trademark "Ethomeen."

The three components of the rust inhibiting composition of this invention, namely, a calcium hydroxide overbased oil-soluble calcium sulfonate, hexylene glycol, and an ethoxylated aliphatic amine surfactant may be mixed in any conventional manner. The relative amounts of each component may be varied although an admixture in which the calcium hydroxide overbased oil-soluble calcium sulfonate, hexylene glycol, and surfactant are present in the approximate ratio in parts by weight of about 1:0.2:0.25–1 respectively, is preferred.

The three-component composition may be usefully incorporated in a wide variety of oils either directly or as part of an additive concentrate composition, e.g. together with a petroleum based oil of lubricating oil quality. When so incorporated in an additive concentrate composition the three-component composition desirably constitutes from 3–50%, preferably 5–30%, by weight based on said additive concentrate composition.

The three-component rust inhibiting composition may desirably be used in combination with other lubricant additives to prepare a crankcase lubricating oil composition or an engine oil. Thus, for example, an additive composition can be prepared which is useful in inhibiting rust formation which includes a minor amount of the three-component composition of the present invention and a major amount relative to the amount of the three-component composition of an oil-soluble or oil-dispersible mixture which includes the reaction product of the zinc salt of a mixed alcohol and phosphorus pentasulfide, a mono(betahydroxyethyl)alkane thiophosphonate, and an overbased calcium sulfonate, all of the components being dissolved or dispersed in a solvent-refined lubricating oil. This second additive mixture desirably contains about 4.0% by weight sulfur, 6.6% by weight calcium, 2.1% by weight zinc and 2.4% by weight phosphorus.

Such a second additive mixture was prepared in the following way. About 2.7 moles of an alcohol mixture (consisting of about 50% primary heptanols, 20% secondary heptanols, 10% hexanols, 10% octanols, 5% butanols and 5% minor components) and 2.3 moles of isopropanol was reacted with 1.0 mole $P_2S_5$. The resulting dialkyldithiophosphonic acid was reacted with an excess of zinc oxide to form the zinc salt. The zinc content may be adjusted to 11.0–11.5% Zn by addition of a low viscosity solvent-refined lubricating oil, e.g. 100 E Pale Oil HF which has an SUS viscosity at 100° F. of from 96–104 and an API gravity of from 27–31.

Mono(beta-hydroxyethyl)alkene thiophosphonate was prepared by reacting ethylene oxide with one mole of an olefin-$P_2S_5$ acid and blowing the product with $NO_2$ to improve the odor. The final product which contains one mole of ethylene oxide per mole of alkenethiophosphonic acid and is neutral to phenolphthalein is adjusted to about 44% active material by the addition of 100 E Pale Oil HF.

An overbased calcium sulfonate was prepared by forming a dispersion in calcium sulfonate of approximately 10–20 moles of dispersed calcium, chiefly as the carbonate, per mole of calcium sulfonate. The sulfonate can be either natural, synthetic or a mixture of both. The concentration of overbased calcium sulfonate was adjusted to about 40–50% by weight with a diluent oil such as 100 E Pale Oil HF.

The zinc mixed alcohol salt, mono(beta-hydroxyethyl) alkene thiophosphonate and overbased calcium sulfonate were then dissolved or dispersed in a solvent refined lubricating oil. Specifically, 15.7% by volume of the zinc salt, 42.8% by volume of the mono(beta-hydroxyethyl)alkene thiophosphonate and 28.6% by volume of the overbased calcium sulfonate were dissolved or dispersed in 12.8% by volume of 100 E Pale Oil HF. The resulting additive meets the requirements of military specification MIL-L-2104, provides good MS Oil Test performance, and is useful in motor and diesel oils. Upon analysis this additive contained 4.0% by weight sulfur, 3.6% by weight calcium, 2.1% by weight zinc and 2.4% by weight phosphorus.

In order to test the effectiveness of the rust-inhibiting composition of the present invention a series of oil blends were prepared. All blends contained solvent neutral oils. The three components of the composition, namely, ethoxylated amines, hexylene glycol, and calcium overbased calcium sulfonate were added to the solvent neutral oil singly or in various combinations. Many of the blends also contained the additive described hereinabove. 5.70% by weight of this latter additive contributes 0.20% Ca from the overbased calcium sulfonate, 0.02% P from the mono(beta-hydroxyethyl)alkene thiophosphonate and 0.12% Zn from the zinc salt, and provides a formulation which satisfies the requirements of military specifications MIL-L-2104B. The additive is also suitable for preservative oil formulation. Table I summarizes the results of these tests.

Referring to Table I, blends A, B and C contained diethoxylated cocoamine, pentaethoxylated soyamine, and diethoxylated soyamine, respectively. Comparison shows that the diethoxylated amines were more effective than the pentaethoxylated amine.

Blend D which contained only the additive package performed poorly in the tests.

The results in blends E through M show that synergism exists between diethoxylated cocoamine, calcium overbased calcium sulfonate and hexylene glycol, and that all three components are necessary to provide sufficient rust protection to pass all four tests. Diethoxylated cocoamine was effective at 1% although it failed the Salt Water immersion Test (E). At 0.25% it performed poorly (F). Hexylene glycol and overbased calcium sulfononate alone (G and H respectively) gave poor results. No combination of any two components was effective enough to pass all the tests (I, J, K) although the combination of diethoxylated cocoamine and overbased calcium sulfonate gave a promising Humidity Cabinet Test.

TABLE I

| | A | B | C | D | E | F | G | H | I | J | K | L | M |
|---|---|---|---|---|---|---|---|---|---|---|---|---|---|
| Additive Package %wt[a] | | | | 5.70 | 5.70 | 5.70 | 5.70 | 5.70 | 5.70 | 5.70 | 5.70 | 5.70 | 5.70 |
| Overbased Calcium Sulfonate | | | | | | | | 1.0 | | 1.0 | 1.0 | 1.0 | 1.0 |
| Hexylene Glycol | | | | | | | 0.20 | | 0.20 | 0.20 | | 0.20 | 0.20 |
| Diethoxylated Cocoamine | 2.0 | | | | 1.0 | 0.25 | | | 0.25 | | 0.25 | 1.0 | 1.0 |
| Pentaethoxylated Soyamine | | 2.0 | | | | | | | | | | | |

TABLE I-continued

| | A | B | C | D | E | F | G | H | I | J | K | L | M |
|---|---|---|---|---|---|---|---|---|---|---|---|---|---|
| Diethoxylated Soyamine | | | 2.0 | | | | | | | | | | |
| ASTM Salt Water Rust Test | Clean | 100% Rust | Clean | 50% Rust | — | — | — | <1% Rust | Clean | — | Clean | Clean | Clean |
| Salt Water Immersion test | Clean | Lt. Rust | Clean | 20% Rust | 20% Rust | 10% Rust | 50% Rust | 10% Rust | Clean | 10% Rust | 20% Rust | Clean | Clean |
| Dilute HBr Neutralization Test | 10% Rust | 90% Rust | Clean | 100% Rust | Clean | 20% Rust | 90% Rust | 100% Rust | 20% Rust | 90% Rust | <1% Rust | Clean | Clean |
| Humidity Cabinet Test | 240 Hrs. | 24 Hrs. | 92 Hrs. | 24 Hrs. | 672 Hrs. | 24 Hrs. | 24 Hrs. | 24 Hrs. | 24 Hrs. | 24 Hrs. | 696 Hrs. | 1008+ Hrs. | 1008+ Hrs. |

[a]This additive package as described herein contains overbased calcium sulfonate, mono(beta-hydroxyethyl)alkene thiophosphonate, and the zinc salt of a mixed alcohol and phosphorus pentasulfide.

The blends (L and M) which contained all three components gave excellent performance in all four of the bench rust tests.

In order to evaluate the rust inhibiting compositions the bench rust tests that are used in the development of preservative oils have been employed, namely, the ASTM Salt Water Rust Test, the Salt Water Immersion Test, the Dilute HBr Neutralization Test, and the Humidty Cabinet Test.

ASTM SW Rust Test

(ASTM Method D-665-60, Procedure B)

A cylindrical metal specimen was placed in 300 mls of the blend being tested in a 400 ml beaker. The temperature of the blend was maintained at 140° F. with stirring at 1000 rpm for 30 minutes. 30 mls of synthetic sea water was added to the beaker and stirring was continued for 24 hours. The metal specimen was then removed and examined. The absence or presence of rust (as an approximate percentage of the surface area exhibiting corrosion, was noted. The metal specimen should be clean, that is, should be free of rust for the blend to be considered an effective rust inhibitor.

Salt Water Immersion Test

(U.S. Army Specification 2-126)

Bright steel test panels were dipped in the blend under test for one minute at 77° F. and allowed to drain for 20 hours at room temperature. The panels were then immersed in synthetic sea water for one day maintained at about 77° F., adjusted to a pH value of 7.8 to 8.2. After one day of immersion the panels were rinsed in distilled water, acetone and precipitation naptha, dried, and inspected immediately. The absence or presence of rust (as an approximate percentage of the surface area exhibiting corrosion) was noted. The panels should be clean, that is, be free of rust for the blend to be considered an effective rust inhibitor.

Dilute HBr Neutralization Test

(U.S. Army Specification 2-126)

Bright steel test panels were dipped in 0.1±0.01% aqueous HBr for one second. The panels were then immersed in the blend under test for one minute with vigorous swishing. The panels were then removed and allowed to stand for 4 hours at room temperature. After 4 hours the panels were rinsed in hot, distilled water and precipitation naphtha, and immediately inspected. The absence or presence of rust (as an approximate percentage of the surface area exhibiting corrosion) was noted. The panels should be clean, that is, be free of rust for the blend to be considered an effective rust inhibitor.

Humidity Cabinet Test

(MIL-L-644A)

Bright steel test panels were immersed in the blend under test at room temperature for one minute and allowed to drain for 2 hours. The panels were then suspended in a humidity cabinet operating at 120° F. with a relative humidity of 100%. The panels were periodically examined for corrosion and the time elapsed without rusting noted. The absence of rusting or corrosion after 720 hours or more is considered acceptable for an effective rust inhibitor.

The rust inhibiting composition of the present invention may also be used in combination with a balanced dispersant-detergent additive in 2-cycle engine oils such as outboard motor oils. Thus, a minor amount of the three-component composition of the present invention, e.g. an amount less than 30% by weight, may be mixed with a succinimide prepared from tetraethylene pentamine and an alkenylsuccinic anhydride derived from a polybutene of molecular weight 800–1000 which has been dissolved or dispersed in a solvent refined lubricating oil. Such succinimides are described in co-assigned U.S. Pat. No. 3,969,235. The disclosure thereof is hereby incorporated into the present disclosure.

Specifically, a succinimide was prepared as the thermal reaction product of tetraethylene pentamine with an alkenylsuccinic anhydride. The alkenylsuccinic anhydride is derived from the thermal reaction of a polybutene-olefin of 800–1000 molecular weight with maleic anhydride (molar ratio 1:1 to 1.0:0.8. The amine: alkenylsuccinic anhydride molar ratio is approximately 0.9:1.0. About 65–80% by weight of the succinimide is dissolved or dispersed in about 35–20 by weight of a light paraffinic diluent oil such as 100 E Pale Oil HF. The succinimide is useful as an additive in 2-cycle engine oils. It is also effective as a detergent-dispersant in both crankcase and automatic transmission oils.

The combined additive which includes the three-component composition of the present invention and the succinimide dissolved or dispersed in a lubricating oil is usefully mixed with gasoline for use in 2-cycle engines. When so used the combined additive is useful in amounts in the range 25–100 parts by weight gasoline per part by weight combined additive, preferably about 50 parts by weight gas per part by weight combined additive.

As will be obvious to one skilled in the art many modifications, variations and/or alterations can be made in the present invention without departing from the spirit or scope thereof as set forth in the claims which follow.

I claim:

1. A composition useful as a rust inhibiting additive for oils comprising a first admixture of calcium hydroxide overbased oil-soluble calcium sulfonate, hexylene glycol and a surfactant consisting of an ethoxylated aliphatic amine, and a second oil-soluble admixture comprising the zinc salt of the reaction product of an alcohol mixture, and phosphorus pentasulfide, in the proportion of about 5 moles of said alcohol mixture to 1 mole of said phosphorus pentasulfide, said alcohol mixture consisting of about 2.7 moles of a mixture consisting of about 50% primary heptanols, 20% secondary heptanols, 10% hexanols, 10% octanols, 5% butanols and 5% minor components and 2.3 moles of isopropanol, to form a dialkyldithiophosphonic acid and reacting said dialkyldithiophosphonic acid with an excess of zinc oxide to form said zinc salt, a mono(beta-hydroxyethyl) alkene thiophosphonate and a calcium carbonate overbased calcium sulfonate dissolved or dispersed in a solvent refined lubricating oil, said second admixture containing about 4.0% by weight sulfur, 3.6% by weight calcium, 2.1% by weight zinc and 2.4% by weight phosphorus.

2. A composition in accordance with claim 1 wherein said calcium hydroxide overbased oil-soluble calcium sulfonate contains approximately 30–35% by weight active ingredients.

3. A composition in accordance with claim 1 wherein said calcium hydroxide overbased oil-soluble calcium sulfonate contains about 2% by weight calcium.

4. A composition in accordance with claim 1 wherein said ethoxylated aliphatic amine is a diethoxylated aliphatic amine with an alkyl group in the range $C_8$–$C_{18}$.

5. A composition in accordance with claim 1 wherein said ethoxylated aliphatic amine is diethoxylated soyamine.

6. A composition in accordance with claim 1 wherein said ethoxylated aliphatic amine is diethoxylated cocoamine.

7. A composition in accordance with claim 6 wherein said diethoxylated cocoamine has the approximate formula

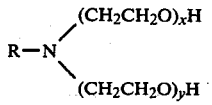

wherein the R moiety is derived from cocoamine and is substantially a $C_{12}$ alkyl group and wherein $x+y=2$.

8. A composition in accordance with claim 1 wherein said calcium hydroxide overbased oil-soluble calcium sulfonate, hexylene glycol and surfactant are present in the approximate ratio in parts by weight of about 1:0.2:0.25-1.

9. A composition in accordance with claim 8 wherein said surfactant is diethoxylated cocoamine.

10. An additive concentrate composition useful as a rust inhibiting additive for oils comprising a petroleum based oil of lubricating oil quality and 3–50% by weight based on said additive concentrate composition of a composition in accordance with claim 1.

11. A method of inhibiting rust formation on metal surfaces which comprises applying to said metal surfaces a petroleum based oil comprising a minor amount by weight of a composition in accordance with claim 1.

12. A method of inhibiting rust formation on metal surfaces which comprises applying to said metal surfaces a petroleum based oil comprising a minor amount by weight of a composition in accordance with claim 4.

* * * * *